United States Patent [19]

Corbari

[11] Patent Number: 4,466,205

[45] Date of Patent: Aug. 21, 1984

[54] SAFETY STUD

[76] Inventor: George V. Corbari, 254 Cecil Plance, Costa Mesa, Calif. 92627

[21] Appl. No.: 456,609

[22] Filed: Jan. 10, 1983

[51] Int. Cl.[3] ..... A43C 15/02; A43C 15/16

[52] U.S. Cl. ..... 36/134; 36/62; 36/67 D

[58] Field of Search ..... 36/67 A, 67 B, 67 C, 36/67 D, 62, 65, 134

[56] References Cited

U.S. PATENT DOCUMENTS

| | | | |
|---|---|---|---|
| 2,222,650 | 11/1940 | Brady | 36/67 D |
| 2,258,734 | 10/1941 | Brady | 36/134 |
| 2,299,927 | 10/1942 | Pierce et al. | 36/67 D |
| 3,328,901 | 7/1967 | Strickland | 36/134 |
| 3,559,309 | 2/1971 | Taylor | 36/7.3 |
| 4,146,979 | 4/1979 | Fabbrie | 36/67 D |

FOREIGN PATENT DOCUMENTS

| | | | |
|---|---|---|---|
| 2607402 | 8/1977 | Fed. Rep. of Germany | 36/67 D |
| 2398471 | 3/1979 | France | 36/67 D |

*Primary Examiner*—Werner H. Schroeder
*Assistant Examiner*—Steven N. Meyers
*Attorney, Agent, or Firm*—Gilbert A. Thomas

[57] ABSTRACT

A sport safety stud for use on hard or soft surfaces which is composed of a stud with a threaded boss on the bottom, a flange in the center and a spike on top, a dome-shaped piece of resilient material resting on the top of the flange. A ring of rigid material encircling the flange and bottom of the resilient material, with an inward bent lip. A disc with a center opening for the threaded boss, which places the ring in tension, holding the ring, resilient material and stud i tight combination.

6 Claims, 3 Drawing Figures

SAFETY STUD

BACKGROUND OF THE INVENTION

1. Field of the Invention

This invention relates generally to cleats for use with sport shoes and more particularly to safety cleats for use in golf shoes to prevent tripping when walking and at the same time give the stability of a cleat when at rest.

2. Description of the Prior Art

As is well-known in the art various problems and difficulties are encountered in providing a sport shoe that can exhibit safe features when walking at the same time give stability when in use.

Many devices have been designed to overcome the problems of scratching and perforating the hard surfaces that one walks on but there are no examples that achieve the desired results.

A patent search was conducted in the field of the art. None of the prior art disclosed a similar cleat. U.S. Pat. No. 4,146,979 comes closest but has the flaw that there is no cement that can hold the dome-shaped body 35 onto a metal flange 24. Molding a plastic material in the shape of a dome 35 does not improve significantly the adhesion of 35 to flange 24.

U.S. Pat. No. 3,739,499 discloses a method of construction of a golf shoe heel and instep. The inventor in no way suggests any of the features of the present invention. U.S. Pat. No. 3,559,309 discloses an overshoe that is pierced by the spikes and whose insole assists in cleaning the spikes when the spikes are withdrawn. However, to the applicants knowledge, there is no feasible invention that has the practicality of extensive use and that is readily acceptable to the market place.

Accordingly, the following described invention discloses a new and unique concept that will no longer cause the user to trip over objects by having long exposed spikes on his shoes.

SUMMARY OF THE INVENTION

The present invention comprises a sport shoe cleat that includes an elongated spike member having an annular truncated flange member integrally formed therewith. The spike extends outwardly or downwardly from the sole of the shoe when standing weight is applied thereto so as to be received in the ground or turf of the playing area. Extending outwardly from the annular flange and opposite from the spike member is an aligned threaded boss member adapted to be received and secured in the sole of the shoe.

On the top of the cleat flange rests a dome-shaped body of resilient material through which a tip of the spike projects. A ring of material with an inward bending lip surrounds the flange and the resilient body extending slightly below the flange to receive a disc that contains a central opening for the threaded boss and is force fit into the bottom of the ring keeping the ring in tension. The domed sponge body is calculated to deflect objects that interfer when walking, making walking easier and prevent tripping over carpets, doorway runners and door mats. It also would make perforating thin hard surfaces nearly impossible. When the user is standing on a soft surface like a golf course or playing field the resilient dome is depressed to permit the spike of the cleat to take hold and give the user the stability he desires. The lip or bent in portion of the ring-like collar holds the sponge dome tightly in place and no adhesive is needed. A metal disc is forced into the bottom of the ring into a tight frictional relationship with the metal ring and with the threaded portion of the stud protruding through the center of such disc. An annular groove around the circumference of the outer end of the threaded boss member is formed to receive the edge of the center of the disc and lock the disc in tight frictional relationship with said ring or collar.

The metal ring is designed to be lightly deformed in tension by said disc during and after installation thereof. An annular groove is formed by said ring and said angular flange member. This annular groove is smaller than the sponge dome within it and assists in retaining the sponge body on the cleat. The four grooves for removing worn or broken cleats may be replaced by a knurled circumference on the bent inward portion of the ring.

One of the objects and advantages of the present invention is to allow users to walk on hard surfaces without long protruding spikes to trip the user or penetrate the surface.

Another object of the invention is to hold the domes sponge part without chemical adhesive but with mechanical means only.

Still another object of the invention is the cleaning of the shoes attached to the stud by the domed portion after use of the stud in a soft environment.

Objects and advantages other than those set forth above will be apparent from the following description when read in conjunction with the accompanying drawings.

DESCRIPTION OF THE PREFERRED EMBODIMENT

Figure 1:
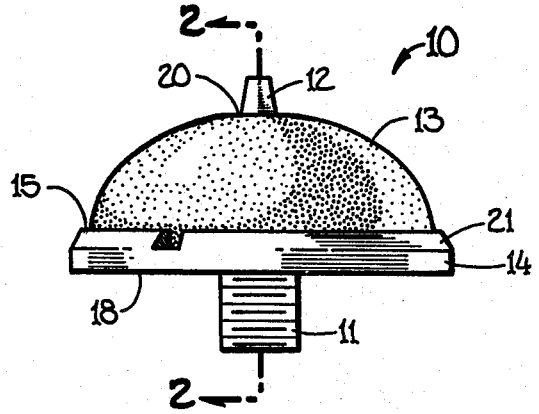
FIG. 1 is a side view of the invention.
Figure 2:
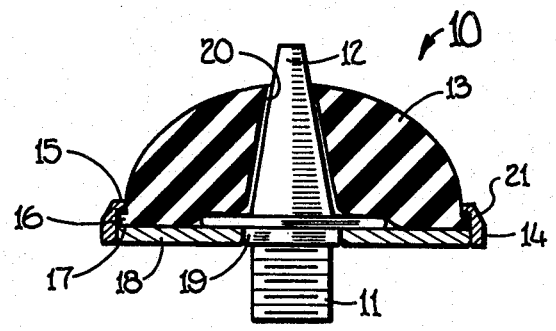
FIG. 2 is a cross-sectional view of FIG. 1 through 2—2.

Referring more particularly to FIG. 1 a side view of the cleat of the invention 10 can be seen. A cleat 10 is composed of a threaded metal boss 11 and a pointed opposite end 12. A dome-shaped resilient body 13 of either plastic or foamed rubber may be used. The dome-shaped body is mechanically secured to the cleat by a metal ring 14 which has an inward bending part 15 or lip. An annular metal groove 16 is formed by said inwardly bending part 15 and the annular flange 17 of the cleat. A metal disc 18 is forcibly wedged into the bottom of metal ring 14 and an annular groove 19. This places the ring in tension holding the ring 14 into tight relationship with sponge body 13 eliminating the need for adhesives. The ring 14 and metal disc 18 by their action contain the parts 10, 13, 14 and 18 in tight interengagement. It can be seen that spike 12 is shielded by foam body 13 so that when walking on a hard surface any projections bump against the foam body 13 where they are deflected while the user lifts his foot a little higher instead of tripping as he would if unshielded spike 12 caught on the object. The tip of spike 12 that is exposed is too small to cause catching, tripping or perforation. It can be seen that sponge body 13 will contract when a soft surface is stood upon exposing more of spike 12 to give stability to the user. After use the sponge body 13 will expand again effectively cleaning the shoe. (Not shown). The annular hole 20 in sponge body 13 is smaller in circumference than the spike 21 so it sweeps debris before it when the user walks on a hard surface giving the cleat a shoe cleaning advantage as a happy by-product.

Figure 3:
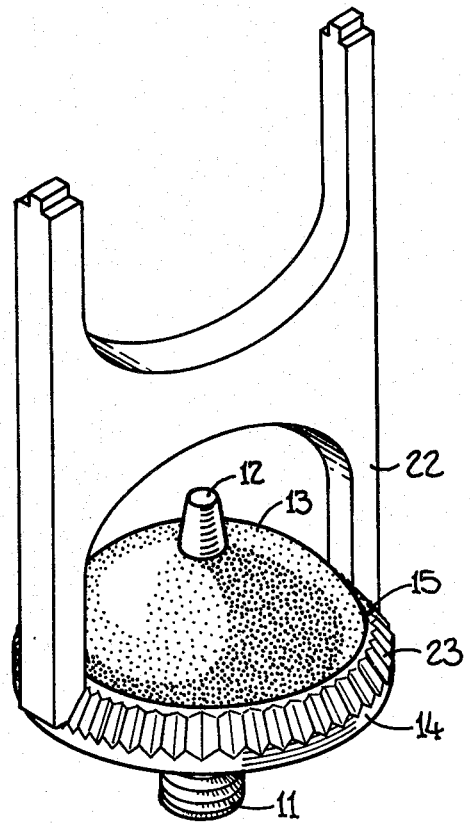
FIG. 3 is a top elevational view of another mode of the invention.

Another mode of the invention is seen in FIG. 3. In this mode a knurl is placed upon the slated portion of the lip 21 and a special tool 22 engages the knurl 23 and enables the user to tighten or loosen the stud. The special tool 22 is shaped on the opposite end to handle a standard metal stud. The invention and its attendant advantages will be understood from the foregoing description, and it will be apparent that various changes may be made in the form, construction and arrangement of the parts of the invention without departing from the spirit and scope thereof or sacrificing its material advantages, the arrangement herein before described being merely by way of example and does not restrict it to the specific form shown or uses mentioned, except as defined in the accompanying claims.

I claim:

1. A cleat for use in sports shoes comprising:

a tapped bore substantially normal to said sole;

a plurality of cleats that are operatively associated with said plugs, each cleat including;

an external threaded boss means that extends upward from said cleat and is designed to engage said tapped bore;

a rigid tapered spike means that extends from said cleat in a direction opposite said boss means, with a horizontal end portion;

a domed body means of resilient material, but collapses when the individual walks on a soft surface, with a central hole through which the end of the spike protrudes;

a rigid flange means of substantially greater transverse cross section than that of the plug that has a central opening that fits on said boss holding the domed body in place;

a ring means encircling said flange and domed body trapping the bottom portion of the domed body against the flange means and holding the flange means in place against the domed body and an inward bent lip on top of the ring; and, a disc means, with a central hole for accomodation of the threaded boss means said disc means is forceably fit into the bottom of the ring means placing the ring in tention, holding the ring, rigid flange, domed body and sports stud in permanent combination.

2. A rigid flange means as described in claim 1 in which the material used to make the flange is metal.

3. An externally threaded boss means as described in claim 1 in which the material used to make the boss is metal.

4. A domed body means as described in claim 1 in which the resilient material may be foamed rubber.

5. A ring means as described in claim 1 in which the ring material means is metal.

6. A disc means as described in claim 1 in which the material used to make the disc is metal.

* * * * *